US011685634B2

(12) United States Patent
Titchener et al.

(10) Patent No.: US 11,685,634 B2
(45) Date of Patent: Jun. 27, 2023

(54) STAIRLIFTS

(71) Applicant: Stannah Stairlifts Limited, Hampshire (GB)

(72) Inventors: Nigel Titchener, Andover (GB); Paul Alexander Cook, Shrewton (GB)

(73) Assignee: Stannah Stairlifts Limited, Hampshire (GB)

( * ) Notice: Subject to any disclaimer, the term of this patent is extended or adjusted under 35 U.S.C. 154(b) by 285 days.

(21) Appl. No.: 16/637,431

(22) PCT Filed: Jul. 31, 2018

(86) PCT No.: PCT/GB2018/052176

§ 371 (c)(1),
(2) Date: Feb. 7, 2020

(87) PCT Pub. No.: WO2019/030498

PCT Pub. Date: Feb. 14, 2019

(65) Prior Publication Data

US 2020/0165103 A1 May 28, 2020

(30) Foreign Application Priority Data

Aug. 9, 2017 (GB) ..... 1712745

(51) Int. Cl.

| | |
|---|---|
| ***B66B 9/08*** | (2006.01) |
| ***B66B 1/30*** | (2006.01) |
| ***B66B 5/00*** | (2006.01) |
| ***B66B 5/02*** | (2006.01) |

(52) U.S. Cl.
CPC ..... *B66B 9/08* (2013.01); *B66B 1/30* (2013.01); *B66B 5/0031* (2013.01); *B66B 5/02* (2013.01)

(58) Field of Classification Search
CPC ..... B66B 9/08; B66B 1/30; B66B 5/0031; B66B 5/02; B66B 5/0006; B66B 5/0018
See application file for complete search history.

(56) References Cited

U.S. PATENT DOCUMENTS

| | | | | |
|---|---|---|---|---|
| 4,904,916 | A * | 2/1990 | Gisske | B66B 9/083 398/1 |
| 8,087,495 | B2 * | 1/2012 | Szentistvany | B66B 9/0815 187/202 |
| 8,365,869 | B2 * | 2/2013 | Stannah | B66B 9/0853 187/202 |
| 2002/0113877 | A1 * | 8/2002 | Welch | B66B 27/00 348/148 |
| 2007/0051562 | A1 * | 3/2007 | Titchener | B66B 9/0853 187/200 |

(Continued)

FOREIGN PATENT DOCUMENTS

| | | |
|---|---|---|
| EP | 1772412 A1 | 4/2007 |
| JP | 2012184062 A | 9/2012 |

(Continued)

*Primary Examiner* — Michael A Riegelman
(74) *Attorney, Agent, or Firm* — Dinsmore & Shohl LLP

(57) ABSTRACT

A method is provided for ensuring the integrity of a stairlift installation constructed from re-used components. Data representative of the form of a stairlift rail is stored in a control facility included in the stairlift carriage and then compared with data sensed in real time. A stairlift carriage may be disabled in the event sensed data varies from stored data.

14 Claims, 1 Drawing Sheet

(56) References Cited

U.S. PATENT DOCUMENTS

| | | | | |
|---|---|---|---|---|
| 2008/0035430 | A1* | 2/2008 | Van Der Heiden | B66B 9/08 187/201 |
| 2008/0268831 | A1* | 10/2008 | Hall | B66B 5/0031 455/424 |
| 2010/0274409 | A1* | 10/2010 | Smith | B66B 9/0838 700/304 |
| 2010/0314201 | A1* | 12/2010 | Stannah | B66B 9/0853 187/201 |
| 2011/0088977 | A1* | 4/2011 | Woodhams | B66B 9/08 187/201 |
| 2018/0044133 | A1* | 2/2018 | Cook | B66B 1/30 |
| 2018/0072537 | A1* | 3/2018 | Pugh | B66B 9/08 |
| 2020/0165103 | A1* | 5/2020 | Titchener | B66B 1/30 |
| 2020/0283262 | A1* | 9/2020 | Piper | B66B 1/468 |
| 2020/0307959 | A1* | 10/2020 | Felis | B66B 19/00 |

FOREIGN PATENT DOCUMENTS

| | | | |
|---|---|---|---|
| WO | 1992/20604 | | 11/1992 |
| WO | 1999/46198 | A1 | 9/1999 |
| WO | 2007/045837 | A1 | 4/2007 |
| WO | 2011/064582 | A1 | 6/2011 |
| WO | 2013/137730 | A1 | 9/2013 |
| WO | 2014/041351 | A1 | 3/2014 |

* cited by examiner

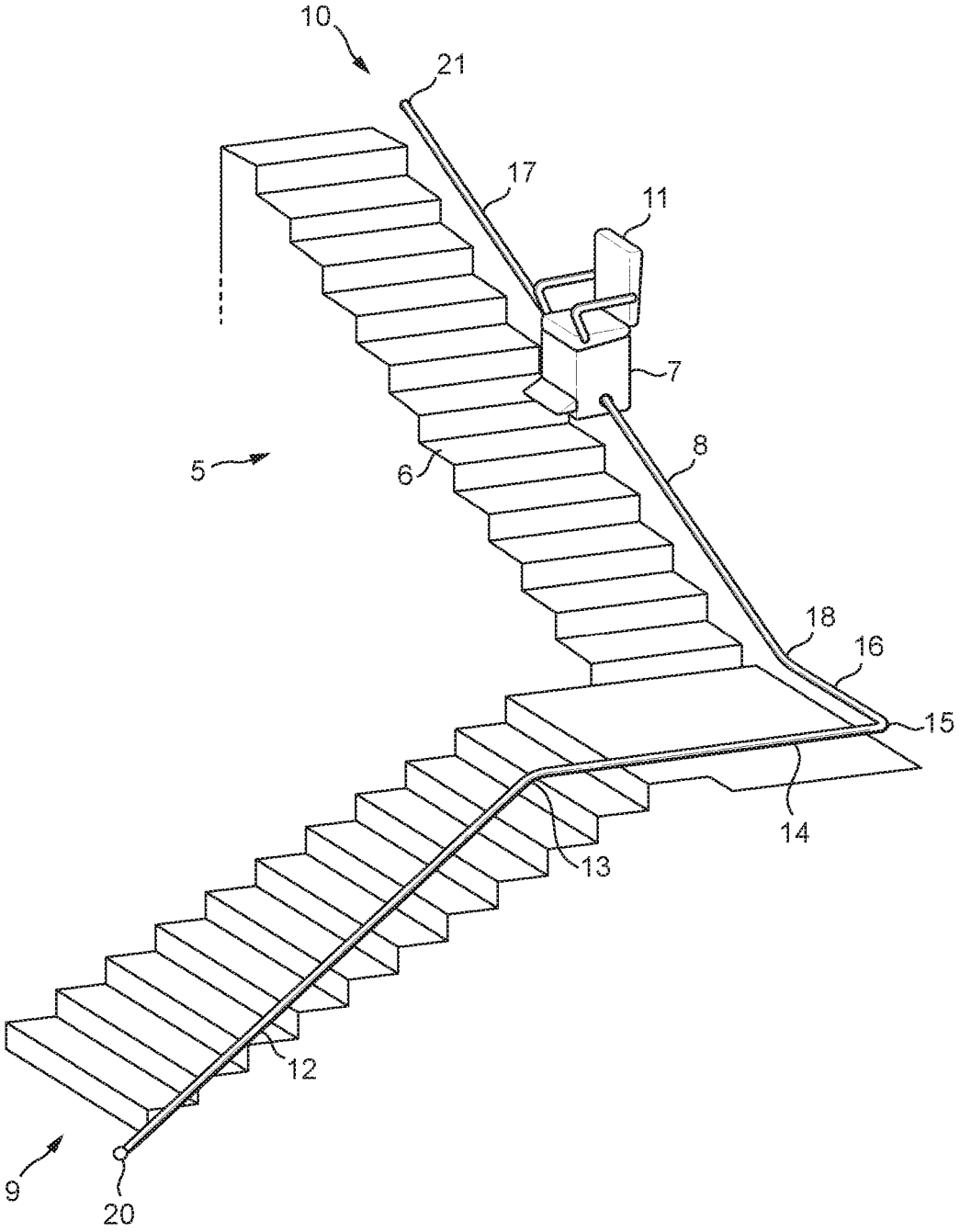
10
21
17
11
7
5
6
8
18
16
15
14
13
12
9
20

STAIRLIFTS

REFERENCE TO RELATED APPLICATIONS

This application is a U.S. national stage application of PCT/GB2018/052176, filed Jul. 31, 2018, which claims priority to Great Britain application No. GB1712745.7, filed Aug. 9, 2017, the entire content of both of which is incorporated herein by reference.

FIELD OF THE INVENTION

This invention relates to stairlifts and, in particular, to a method of and/or apparatus for, ensuring the safety or integrity of a stairlift installation.

FIELD OF THE INVENTION

A stairlift is a safety critical piece of equipment. Manufacturers of stairlifts are required to comply with strict standards governing design and construction and installation but, once a stairlift has been installed, there is little or no control over the subsequent treatment of the product. The potential problems that arise from this are exacerbated by a trend towards supplying stairlift rails assembled from a kitset of standard components as described in International Patent Applications WO92/20604, WO99/46198 & WO2011/064582. With this trend, any person, regardless of skill, can readily source second-hand stairlift carriage and rail parts and perform a stairlift installation. Not only does this expose stairlift users to uncontrolled risk but, in the event of failure, that failure will inevitably be associated with the original equipment manufacturer even though it may result from the second-hand installer.

It is an object of the invention to provide a method and/or apparatus which will go at least some way in addressing the aforementioned problems; or which will at least provide a novel and useful choice.

SUMMARY OF THE INVENTION

Accordingly, in a first aspect, the invention provides a method of controlling the operation of a stairlift comprising a stairlift carriage operable to move along, a stairlift rail wherein said rail has defined fixed parameters upon installation, said method being characterised by configuring a control facility within said carriage to monitor at least one of said defined fixed parameters and to respond upon a variation in said at least one of said defined parameters being detected.

Preferably said carriage or a chair mounted on said carriage is provided with one or more sensors operable to sense data comparable with said defined fixed parameters, said method including comparing in real time, data derived from said sensors with said defined parameters and responding in the event of a variation there-between.

Preferably said defined fixed parameters include a length of said stairlift rail.

Preferably said defined fixed parameters include a position or an angle of a bend at a de med position along said stairlift rail, or a sequence of angles and/or bend types.

Preferably said defined fixed parameters include an inclination said stairlift rail at a defined position along said stairlift rail.

Preferably said defined fixed parameters are established during the design of said stairlift rail and subsequently transferred to said control facility.

Alternatively said defined fixed parameters are programmed into said control facility at time of installation of said carriage onto said rail at a place of use.

Preferably said defined fixed parameters are established following a defined number of journeys of said stairlift carriage along said stairlift rail.

Preferably said stairlift carriage is configured to respond to a change in said defined fixed parameters by ceasing to operate.

In a second aspect the invention provides a stairlift comprising a stairlift carriage operable to move along a stairlift rail having defined fixed parameters upon installation, said stairlift being characterised in that said carriage includes a control facility configured to monitor said defined fixed parameters and to respond upon detecting a variation in at least one of said defined fixed parameters.

Preferably said stairlift is configured according to the method set forth above.

Many variations in the way the present invention can be performed will present themselves to those skilled in the art. The description which follows is intended as, an illustration only of one means of performing the invention and the lack of description of variants or equivalents should not be regarded as limiting. Subject to the falling within the scope of the appended claims, wherever possible, a description of a specific element should be deemed to include any and all equivalents thereof whether in existence now or in the future.

BRIEF DESCRIPTION OF THE DRAWING

One form of the invention will now be described with reference to the accompanying drawing in which:

FIGURE is an isometric, schematic, view of a stairlift installation.

DETAILED DESCRIPTION OF THE INVENTION

As shown in FIG. 1, the stairlift 5 is mounted along one edge of staircase 6 and comprises a stairlift carriage 7 mounted on a stairlift rail 8 for movement along the rail between a lower end 9 and an upper end 10. In the conventional manner a chair 11 is mounted on the carriage upon which, in use, a user is seated.

In the form shown, the rail 8 comprises a first upwardly inclined section 12 passing through a negative transition bend 13 into a first horizontal section 14. The first horizontal section 14 terminates in an inside bend 15 that, in turn, leads into a second horizontal section 16, the section 16 leading into a second upwardly inclined section 17 through positive transition bend 18.

Conventionally, for a battery-powered stairlift, battery charge points 20 and 21 are provided at or adjacent to the rail ends 9 and 10 respectively.

Mapping of a stairlift rail is known in the art and is broadly described in our European Patent No. 0 728 232. That is to say, it is known to store in an electronic memory fixed parameters such as the lengths of the various rail sections and the manner in which adjacent sections merge into one another. The present invention uses this mapping concept along with one or more sensors monitoring data derived while the carriage 7 is moving along the rail 8, in real time, to determine if the path being followed by the carriage is a departure from the map. If so, then it is assumed that the carriage has been moved onto a different rail and, in this event, the carriage is programmed to cease functioning.

The data sensed and recorded as the carriage moves along the rail preferably includes distance travelled from an end of the rail, and rail inclination.

Alternatively, or in addition, it may include bend type e.g. positive transition, negative transition, inside or outside and/or a sequence in which particular types of bend and/or angles of bend arise. The data may also include the position or positions at which particular types of bend are located along the length of the rail.

Distance is conveniently measured using an encoder and inclination measured using any suitable inclinometer.

In a first simple embodiment of the invention, a control facility (not shown) such as electronic control unit (ECU) within the carriage 7 is programmed with the distance between charge points 20 and 21. During real-time operation of the stairlift, if this distance is found to vary, then a fault is indicated and the carriage will cease to function. In more sophisticated embodiments the carriage ECU is programmed to check distance from a prescribed datum, for example the lower end 9 of the rail, and inclination sensed in real time at various points during its travel along the rail. The ECU may also be programmed with a particular sequence of rail angles or bend types. This data is then compared within the ECU with corresponding data of the stored map and, again, if there is variance between what is sensed and what is stored, then the ECU is programmed to disable the carriage.

In the event a variation is established between what is sensed and what is stored, the carriage is preferably disabled on the next occasion it arrives at the lower end 9 of the rail.

It is to be emphasised that the invention involves comparing real time data with stored data representing fixed parameters of a stairlift rail, and real time data gathering should be programed to overlook rail configuration variances arising from real time movement of components on the rail. An example of such a variance is a folding rail section that is included in some stairlift installations, an example of which is shown in published PCT Patent Application No. WO 2013/137730.

The mapped data may be entered into the ECU of the carriage at the time of installation of the stairlift by running the carriage up and down the bespoke rail so that the inclinations and lengths of the various rail sections can be learned and stored. After a fixed number of runs up and down the rail, the ECU 'locks' the learning function and the carriage is then bound to that rail configuration. If there is a subsequent change to the rail which involves an alteration to the path of the rail, then the ECU is programmed not to learn or map the new path.

As an alternative to the mapping-on-installation procedure described above, data representing a rail map may be generated during, the rail design process familiar to all manufacturers of stairlifts and this data may be represented by a multi-digit code in which the particular combination of digits represents a particular combination of rail sections and bends. As well, the ECU in the carriage or chair is programmed to decrypt the code and, thereby, 'learn' the rail profile.

For example the rail design process may generate an encrypted 4-digit code that describes elements of the rail to be installed and that code will preferably be displayed on the installation drawing given to the installer. At installation the installer accesses the ECU in the stairlift and enters the code. The carriage software then undertakes the decryption and, in so doing, acquires the rail map corresponding to that code. The installer then runs the carriage along the rail so that the sensors can establish real time data, compare this to the map, and determine if the rail is an authorised rail. Thereafter the ECU is programmed to periodically re-check to ensure that the rail still conforms to the map and if a variance is found, the ECU disables the carriage.

The invention claimed is:

1. A method of controlling the operation of a stairlift, comprising a rail, a carriage displaceable along the rail, and a control facility within the carriage configured and operable to control the movement of the carriage on the rail, the method comprising the steps of:

configuring the control facility with defined fixed parameters of the rail;

monitoring for any variations in the parameter of the rail itself, using the control facility to compare, in real time, the defined fixed parameters of the rail within the control facility to the parameters of the rail as the carriage moves along the rail; and initiating a response in the event of a variation being detected.

2. The method as claimed in claim 1, wherein:

said carriage or a chair mounted on said carriage is provided with one or more sensors operable to sense data comparable with said defined fixed parameters;

the step of monitoring comprising comparing, in real time, data derived from said sensors with said defined fixed parameters.

3. The method as claimed in claim 1, wherein said defined fixed parameters are established during a design of said stairlift rail and the step of configuring includes subsequently transferring the defined fixed parameters to said control facility.

4. The method as claimed in claim 1, wherein the step of configuring includes programming said defined fixed parameters into said control facility at time of installation of said carriage onto said rail at a place of use.

5. The method as claimed in claim 4, wherein said defined fixed parameters are established following a defined number of journeys of said stairlift carriage along said stairlift rail.

6. The method as claimed in claim 1, wherein the step of initiating a response comprises ceasing to operate.

7. The method as claimed in claim 1, wherein said defined fixed parameters are selected from a group comprising:

a length of said stairlift rail;

a position or an angle of a bend at a defined position along said stairlift rail, or a sequence of angles or bend types; and an inclination of said stairlift rail at a defined position along said stairlift rail.

8. A stairlift comprising:

a rail;

a carriage displaceable along the rail; and a control facility within the carriage configured and operable to control the movement of the carriage on the rail;

wherein the control facility is configured with defined fixed parameters of the rail, and wherein the control facility is operable;

to monitor for any variations in the parameters of the rail itself, in real time;

to compare the defined fixed parameters of the rail within the control facility to the parameters of the rail as the carriage moves along the rail; and to initiate a response in the event of a variation being detected.

9. A method of controlling the operation of a stairlift, comprising a rail, a carriage displaceable along a path of the rail, and a control facility within the carriage configured and operable to control the movement of the carriage on the rail, the method comprising the steps of:

configuring the control facility with a map of defined fixed parameters of the rail stored in an electronic memory;

comparing in real time, using the control facility, the map of defined fixed parameters of the rail to actual parameters of the rail as the carriage moves along the path of the rail;

determining if the actual parameters of the rail as the carriage moves along the path of the rail is a departure from the map of defined fixed parameters of the rail within the control facility; and initiating a response, in the event that the actual parameters of the rail as the carriage moves along the path of the rail is a departure from the map of defined fixed parameters of the rail within the control facility and, in this event, the carriage is programmed to cease functioning.

10. The method as claimed in claim 9, wherein:

said carriage or a chair mounted on said carriage is provided with one or more sensors operable to sense data comparable with said defined fixed parameters;

the step of monitoring comprising comparing, in real time, data derived from said sensors with said defined fixed parameters.

11. The method as claimed in claim 9, wherein said defined fixed parameters are established during a design of said stairlift rail and the step of configuring includes subsequently transferring the defined fixed parameters to said control facility.

12. The method as claimed in claim 9, wherein the step of configuring includes programming said defined fixed parameters into said control facility at time of installation of said carriage onto said rail at a place of use.

13. The method as claimed in claim 12, wherein said defined fixed parameters are established following a defined number of journeys of said stairlift carriage along said stairlift rail.

14. The method as claimed in claim 9, wherein the step of initiating a response comprises ceasing to operate.

* * * * *